United States Patent [19]

Bailey et al.

[11] 4,071,197

[45] Jan. 31, 1978

[54] FUEL INJECTOR WITH SELF-CENTERING VALVE

[75] Inventors: John M. Bailey, Dunlap; Ronald R. Robinson, Morton, both of Ill.

[73] Assignee: Caterpillar Tractor Co., Peoria, Ill.

[21] Appl. No.: 775,349

[22] Filed: Mar. 7, 1977

Related U.S. Application Data

[63] Continuation of Ser. No. 659,611, Feb. 19, 1976, abandoned.

[51] Int. Cl.[2] ..... B05B 1/30
[52] U.S. Cl. ..... 239/533.11
[58] Field of Search ..... 239/533.3–533.12

[56] References Cited

U.S. PATENT DOCUMENTS

| | | | |
|---|---|---|---|
| 1,759,367 | 5/1930 | Petersen | 239/533.11 X |
| 3,451,626 | 6/1969 | Roosa | 239/533.11 |

FOREIGN PATENT DOCUMENTS

| | | | |
|---|---|---|---|
| 458,551 | 12/1936 | United Kingdom | 239/533.3 |

*Primary Examiner*—John J. Love
*Attorney, Agent, or Firm*—Phillips, Moore, Weissenberger, Lempio & Majestic

[57] ABSTRACT

A fuel injection nozzle with a valve assembly having an inwardly opening check valve is provided with an elongated valve body to space the valve spring away from the nozzle. The valve spring is mounted in a housing which is provided with a spherical seating arrangement within the valve body which provides an effective sealing arrangement as well as self-centering of the valve with its seat regardless of machining variations.

1 Claim, 2 Drawing Figures

FUEL INJECTOR WITH SELF-CENTERING VALVE

This is a continuation, of Ser. No. 659,611, filed Feb. 19, 1976 now abandoned.

BACKGROUND OF THE INVENTION

The present invention relates to fuel injection systems, and pertains more particularly to an injection valve assembly for an internal combustion engine.

Compression ignition engines commonly employ fuel injection nozzles for delivering a timed injection of fuel into the engine combustion chamber. Such nozzles are normally controlled by a pressure-responsive check valve to prevent dribbling of fuel into the combustion chamber between injection strokes. Numerous types of different check valve arrangements have been used in such nozzles; however, each arrangement has been found to have certain disadvantages.

A simple outwardly opening check valve is exemplified by U.S. Pat. No. 2,410,946, issued Nov. 12, 1946 to Lloyd E. Johnson which requires no close tolerances or lap fits. However, its principal disadvantage is the relatively large volume between the check seat and combustion chamber. This volume has a deleterious effect on control of injection and may tend to dribble fuel into the cylinder.

One preferred type of fuel nozzle, because of its operational simplicity, is the differential area type check valve as exemplified by U.S. Pat. No. 2,379,399, issued June 26, 1945 to H. F. Haines, U.S. Pat. No. 2,865,675, issued Dec. 23, 1958 to V. D. Roosa, and U.S. Pat. No. 3,224,684, issued Dec. 21, 1965 to V. D. Roosa. The major problem with these types of fuel nozzle and valve arrangements is that they must employ a low-pressure chamber into which the valve stem must extend in order to provide a low pressure in opposition to the actuating pressure to provide the necessary pressure difference for actuation of the valve. Such valve arrangements result in leakage around the valve stem to the low-pressure chamber, resulting in the need to provide leak off manifolds and the like.

The aforementioned differential area valves also normally employ a rather large compression spring to close the valve. When the spring is located near the fuel orifice, it increases the diameter of the injector valve assembly and the size of bore in the cylinder head required to accommodate it. When the spring is located remote from the fuel orifice, the alignment of the check valve needle becomes more critical.

Other examples of the known prior art are: U.S. Pat. Nos. 3,451,626 issued June 24, 1969 to Roosa; and 3,598,314 issued Aug. 10, 1971 to John M. Bailey et al, and 3,750,960 issued Aug. 7, 1973 to John H. Back et al, both of common assignment herewith.

These valves are selfcentering; however, they have a disadvantage of having the relatively large diameter spring close to the orifices which tends to complicate installation. Also, unlike conventional inwardly opening valves, the spring is located in the higher pressure inlet passage wherein the rather large volume required may adversely affect performance.

SUMMARY AND OBJECTS OF THE INVENTION

It is the primary object of the present invention to provide a fuel nozzle assembly of the inwardly opening type that overcomes the above-mentioned problems of the prior art.

Another object is to provide a simple and inexpensive fuel nozzle valve assembly that eliminates the space and alignment problems of the prior art.

In accordance with the present invention, there is provided a fuel nozzle valve assembly having an elongated valve body, and a spring assembly located remote from the valve orifice. The spring assembly includes a housing mounted on spherical means within the valve housing and includes guide means for the outer end of the valve needle.

BRIEF DESCRIPTION OF THE DRAWINGS

The above-mentioned and other objects and advantages of the present invention will become apparent from the following specification when read in conjunction with the accompanying drawings, wherein.

DETAILED DESCRIPTION OF PREFERRED EMBODIMENT

Figure 1:
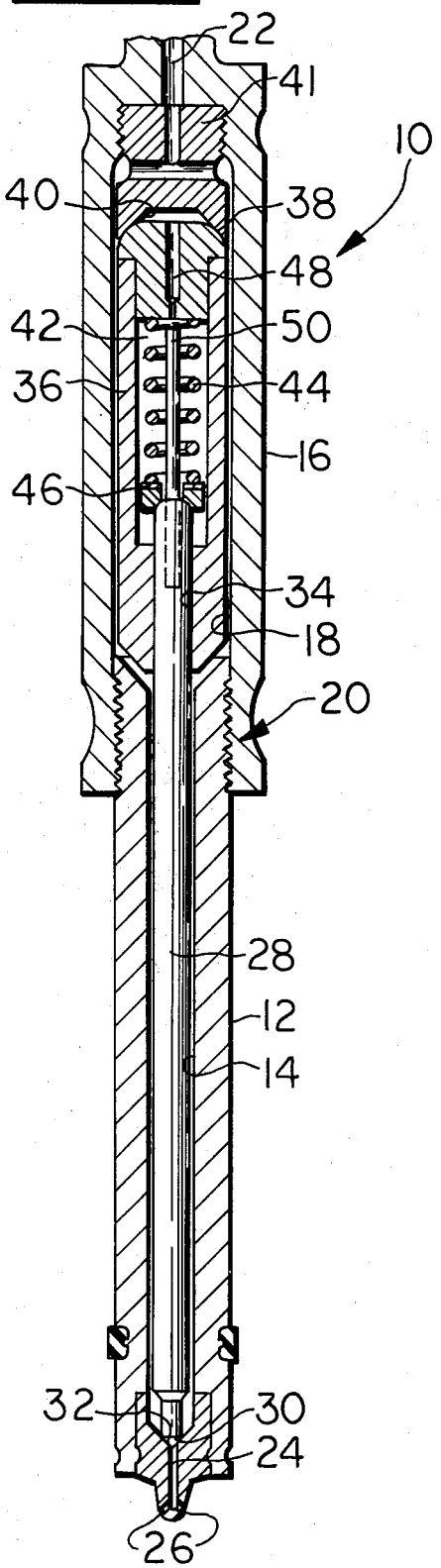
FIG. 1 is a view in section of a preferred embodiment of the present invention.

Referring now to the drawings, particularly to FIG. 1, there is illustrated a valve assembly generally designated by a numeral 10 and comprising a first elongated tubular housing 12 having a cylindrical bore 14 formed therein connected in a suitable manner to a second tubular housing member 16 having a central bore 18 formed therein. These two housing members are secured together by suitable means such as by swaged engagement therebetween indicated generally at 20, and together these two housings define a central valve chamber in the form of a stepped bore. The housing includes an inlet bore 22 for communicating a source of fuel with the valve chamber and at the opposite end of the housing includes an outlet 24 including orifice means 26 for communicating the chamber with a combustion chamber of an engine.

This elongated valve body construction permits the use of a very small bore in the cylinder head of an engine for mounting the injection assembly. With this construction the largest portion of the valve assembly is located outside the bore formed in the cylinder head. This reduces the diameter of the bore necessary for the mounting and avoids the necessity of large holes which may produce weaknesses in the cylinder head.

An elongated cylindrical valve element 28 is reciprocally mounted within the smaller bore 14 within the valve chamber and includes a valve portion 30 at the lower end thereof engaging the valve seat 32 for controlling the communication of the valve chamber within the housing with the combustion chamber of an engine. The valve member 28 is mounted at its upper end in a guide means comprising a bore 34 formed in the lower end of a spring housing 36 which is mounted within the enlarged chamber 18 of the housing 16.

The spring housing 36 includes at its upper end suitable self-aligning guide and mounting means comprising a spherical surface 38 formed on the end of the housing cooperatively engaging a conical shaped bearing surface 40 formed on an insert plug member 41 within the housing 16. This conical spherical bearing engagement arrangement permits ready alignment and self-centering of the valve element within the housing without the requirement of extremely accurate machining of the elements. This arrangement also provides excellent sealing means between the fuel flow path at the outside of the housing 36 and the inside of the housing defining a spring chamber 42. Mounted within this spring chamber is a compression spring 44 which is in operative engagement with the upper end of the valve element 28 to bias it to the seated position to cut off communication between the chamber of bore 14 and the fuel orifices 26.

The spring 44 is biased or disposed between the upper end of chamber 42 and the upper end of the valve member 28 and is provided with suitable spacer means 46 for adjusting the spring force on the valve.

The conical spherical feature 40, 38 prevents the leak-off of fuel from the inlet portion into the inner chamber 42 of the valve housing. Leakage of fuel into this housing would tend to build up pressure therein and prevent operation of the valve itself. A small passageway 48 is provided for any fuel that may leak past these surfaces to be communicated to the relatively large chamber 42 where such very small amounts may accumulate without detriment to the operation of the valve assembly.

A stop 50 is provided in the upper end of valve member 28 for engagement with the upper end of the housing 36 to control the degree of opening movement of the valve member 28.

Figure 2:
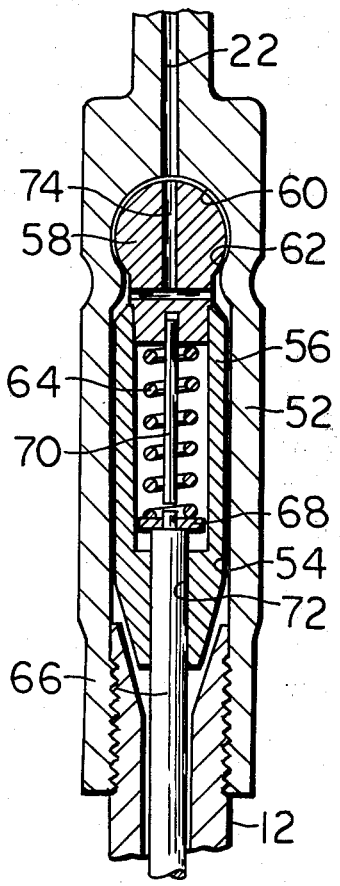
FIG. 2 is a sectional view of an alternate embodiment of the invention.

Turning now to FIG. 2, there is illustrated an alternate embodiment of the present invention. (The lower part of the assembly is substantially the same and thus will not be described.) The embodiment of FIG. 2 includes an upper housing 52 defining a bore 54 and connected to a lower housing assembly 12 as in the previous embodiment. Mounted within the chamber defined by bore 54 is a spring housing 56 which is provided at its upper end with an enlarged spherical ball 58 which engages a spherical shaped surface 60 formed within the upper end of housing 52 and is retained therein by means of the shaping of the housing at 62 which is accomplished by crimping the housing after the spring housing and ball assembly has been inserted in place.

Mounted within the spring housing 56 is a compression spring 64 which is in operative engagement with the upper end of a valve stem 66 and includes suitable spacer means 68 by adjusting the pressure or opening the valve. The lift of the valve is adjusted and controlled by means of a stop means 70 located within the housing 56 and operative to engage the upper end of the valve member 66 at its uppermost position. Suitable guide means 72 is provided in the lower end of housing 56 as in the previous embodiment for guidance of the upper end of valve member 66. As will be appreciated from this construction, the guide means 72 is permitted to orient itself with the forces acting on the valve stem 66 and thus assure alignment of the valve means without binding. Similarly, such function is attributed to the same construction of the FIG. 1 embodiment.

As will be further appreciated from the FIG. 2 embodiment, the spherical construction of the mounting means for the spring housing 56, which also defines the self-aligning means of the assembly, is such that leakage from the inlet passage 22 can only go to the inlet itself, and thus does not affect the operation of the valve whatsoever. Thus any such leakage would flow along the spherical surface and mingle with fluid flowing along passage 74 to the chamber of the housing, which is the inlet anyway.

While this present invention has been described with respect to specific embodiments, it is to be understood that numerous changes and modifications are possible without departing from the spirit and scope of the invention as defined in the appended claims.

We claim:

1. A fuel injection valve assembly comprising:

an elongated housing defining a chamber therein;

inlet means for communicating said chamber with a source of fuel;

outlet means at one end of said housing defining an orifice for communicating said chamber with a combustion chamber;

an elongated valve element reciprocably mounted within said chamber and operative to control communication of said chamber with said outlet orifice;

spring mounting means mounted in the end of said housing remote from said outlet and including guide means for one end of said valve member;

said spring mounting means including self-aligning means mounting said spring mounting means within said one end of said housing, wherein said self-aligning means comprise a spherical bearing surface formed on said spring mounting means cooperatively engaging a spherical surface formed in the end of said chamber, the housing defining said chamber being shaped so that the spherical bearing surface is retained within the spherical surface formed in the end of the chamber.

* * * * *